US005890116A

United States Patent [19]

Itoh et al.

[11] Patent Number: 5,890,116

[45] Date of Patent: Mar. 30, 1999

[54] CONDUCT-ALONG SYSTEM

[75] Inventors: Yasunari Itoh; Hiroyuki Kiyono, both of Unoke-machi, Japan

[73] Assignee: PFU Limited, Ishikawa, Japan

[21] Appl. No.: 789,670

[22] Filed: Jan. 27, 1997

[30] Foreign Application Priority Data

Sep. 13, 1996 [JP] Japan ..... 8-243184

[51] Int. Cl.[6] ..... G10H 1/00; G10H 1/40

[52] U.S. Cl. ..... 704/260; 704/278; 704/503; 84/651; 84/662

[58] Field of Search ..... 704/260, 503; 84/612, 652, 665, 668

[56] References Cited

U.S. PATENT DOCUMENTS 5,005,459 4/1991 Adachi et al. ..... 84/453
5,058,480 10/1991 Suzuki et al. ..... 84/600
5,159,140 10/1992 Kimpara, et al. ..... 84/600
5,355,762 10/1994 Tabata ..... 84/609
5,512,707 4/1996 Ohshima ..... 84/658

FOREIGN PATENT DOCUMENTS 93-22762 11/1993 European Pat. Off. ..... G10H 1/00

*Primary Examiner*—David R. Hudspeth
*Assistant Examiner*—Tālivaldis Ivars Šmits

[57] ABSTRACT

A conduct-along system that can give expressions to sounds and/or images, in which expressions are added to sounds and/or images following the playback of sounds and/or images in real-time based on any one or any combination of parameters, such as tempo, intensity, beat timing and accent, detected from the movement of an input device. The conduct-along system detects any one or any combination of parameters, such as tempo, intensity, beat timing and accent, from the movements of the input device, and plays back voices and/or images in real-time following any one or any combination of detected parameters, such as tempo, intensity, beat timing and accent.

17 Claims, 17 Drawing Sheets

REHEARSAL MODE

CONCERT MODE

FLOW CHART OF OPERATIONS ACCORDING TO THIS INVENTION

TYPICAL CONDUCTING OPERATIONS

VERTICAL MOVEMENT OF MOUSE CURSOR ON COMPUTER SCREEN

GRAPH OF CURSOR SPEED

CONVENTIONAL METHOD FOR CALCULATING TEMPO

METHOD FOR CALCULATING TEMPO

FIG. 10

THE NOTATION GIVEN ON THE RIGHT IS EXPRESSED BY THE FOLLOWING FILE DATA

TYPICAL FILE DATA ACCORDING TO THIS INVENTION (WHERE 8TH NOTE = 240 TICKS)

| DIFFERENCE TIME (TICK) | TYPE | DATA | | (NOTE) | |
|---|---|---|---|---|---|
| 0 | M | 4/4 TIME | | (1) | |
| 0 | M | C MAJOR | | (2) | |
| 0 | T | TEMPO | 120.0 | (3) | |
| 0 | M | CHANGE IN INTENSITY | 127 (MAX) | (4) | |
| 0 | M | NOTEON | 88 (VELOCITY) | (5) | START OF TONE OF MI |
| 0 | M | NOTEON | 88 (VELOCITY) | (6) | START OF TONE SOL |
| 240 | M | CHANGE IN INTENSITY | 63 | (7) | |
| 240 | M | NOTEOFF | 0 (VELOCITY) | (8) | END OF TONE MI |
| 0 | M | NOTEOFF | 0 (VELOCITY) | (9) | END OF TONE SOL |
| 0 | M | NOTEON | 88 (VELOCITY) | (10) | START OF TONE OF DO |
| 960 | M | NOTEOFF | 0 (VELOCITY) | (11) | END OF TONE OF DO |
| 0 | E | END | | (12) | |

FIG. 11

TYPICAL INTERNAL DATA ACCORDING TO THIS INVENTION (WHERE 8TH NOTE = 240 TICKS)

| | PRESENT TIME (TICK) | TYPE | DATA | | (NOTE) |
|---|---|---|---|---|---|
| SONG POINTER → | 0 | B | BEAT DATA | | ADDED TO THE TOP OF DATA |
| | 0 | M | 4/4TIME | | COPIED FROM (1) |
| | 0 | M | C MAJOR | | COPIED FROM (2) |
| | 0 | T | TEMPO | 120.0 | COPIED FROM (3) |
| | 0 | M | CHANGE IN INTENSITY | 127 (MAX) | COPIED FROM (4) |
| | 0 | M | NOTEIN | 88 (VELOCITY) | COPIED FROM (5) |
| | 0 | M | NOYEIN | 88 (VELOCITY) | COPIED FROM (6) |
| | 240 | B | BEAT DATA | | ADDED BASED ON DIFFERENCE TIME OF (6) |
| | 240 | M | CHANGE IN INTENSITY | 63 | COPIED FROM (7) |
| | 480 | B | BEAT DATA | | ADDED BASED ON DIFFERENCE TIME OF (7) |
| | 480 | M | NOTEOFF | 0 (VELOCITY) | COPIED FROM (8) |
| | 480 | M | NOTEOFF | 0 (VELOCITY) | COPIED FROM (9) |
| | 480 | M | NOTEOFF | 88 (VELOCITY) | COPIED FROM (10) |
| | 720 | B | BEAT DATA | | ADDED BASED ON DIFFERENCE TIME OF (10) |
| | 1200 | B | BEAT DATA | | DITTO |
| | 1440 | B | BEAT DATA | | DITTO |
| | 1440 | M | NOTEOFF | 0 (VELOCITY) | COPIED FROM (11) |
| | 1440 | E | END | | COPIED FROM (12) |

FLOW CHART OF PLAYBACK PROCESSING ACCORDING TO THIS INVENTION

FLOW CHART OF UPDATING OF PARAMETERS BASED ON CONDUCTING OPERATIONS ACCORDING TO THIS INVENTION

DISPLAY OF ANIMATION IMAGE

CONDUCT-ALONG SYSTEM

BACKGROUND OF THE INVENTION

1. Field of the Invention

This invention relates to a conduct-along system for adding expressions to sounds and/or images.

2. Description of the Related Art

Everybody knows it is more pleasant to play music than merely listening to it. Without the ability to play a musical instrument, however, it would be difficult to master playing music. Yet, most people would feel resistance in starting a primer of a musical instrument, together with children. In recent years, desk-top music (DTM) that allows novices to enjoy playing music on a personal computer is attracting people's attention. Even with DTM, however, a knowledge of notation is needed. Furthermore, a knowledge of techniques peculiar to DTM, such as the MIDI (Musical Instrument Digital Interface) format, as a standard musical data format in the world of computer music, is essential.

The following methods for adding expressions, such as sound volume and the tempo of playback, to musical or animation data that are played back from time to time have heretofore been known.

(1) A method in which the operator gives expressions data real-time to musical or animation data using a slider or foot-operated control.

(2) A method that gives data statically by editing graphs and numerical data on the computer screen.

The aforementioned method (1) requires a slider or foot-operated control. Furthermore, setting too many parameters simultaneously involves many controllers, making it difficult to operate the system as well as to master how to set parameters.

With the aforementioned method (2), on the other hand, data have to be statically given in advance. This makes it difficult to give desired expressions to voices and/or images at will because what expressions would be provided from the data cannot be readily predicted without sufficient knowledge.

SUMMARY OF THE INVENTION

It is the first object of this invention to provide expressions by following the playback of sounds and/or images real-time based on any one or any combinations of the parameters, such as tempo, intensity and beat timing, detected from the movements of an input device.

It is the second object of this invention to start the playback of sounds and/or images being replayed in synchronism with a song pointer.

It is the third object of this invention to judge beat and bottom points by analyzing the movement of a graphic form drawn by the input device to determine the aforementioned tempo and the aforementioned beat timing.

It is the fourth object of this invention to analyze the movement of a graphic form drawn by the input device to determine the size of the graphic form, thereby determining the aforementioned intensity.

It is the fifth object of this invention to cause playback means for playing back sounds and/or images real-time to receive beat data that describe the analysis results of the movement of a graphic form to prepare internal data, and to play back the aforementioned sounds and/or the aforementioned images by interpreting the internal data.

It is the sixth object of this invention to make it possible to play back sounds and/or images in the rehearsal mode or the concert mode.

BRIEF DESCRIPTION OF THE DRAWINGS

FIG. 10 is a diagram of assistance in explaining file data of this invention.

FIG. 11 is a diagram of assistance in explaining internal data of this invention.

DETAILED DESCRIPTION OF THE EMBODIMENTS

Figure 1:
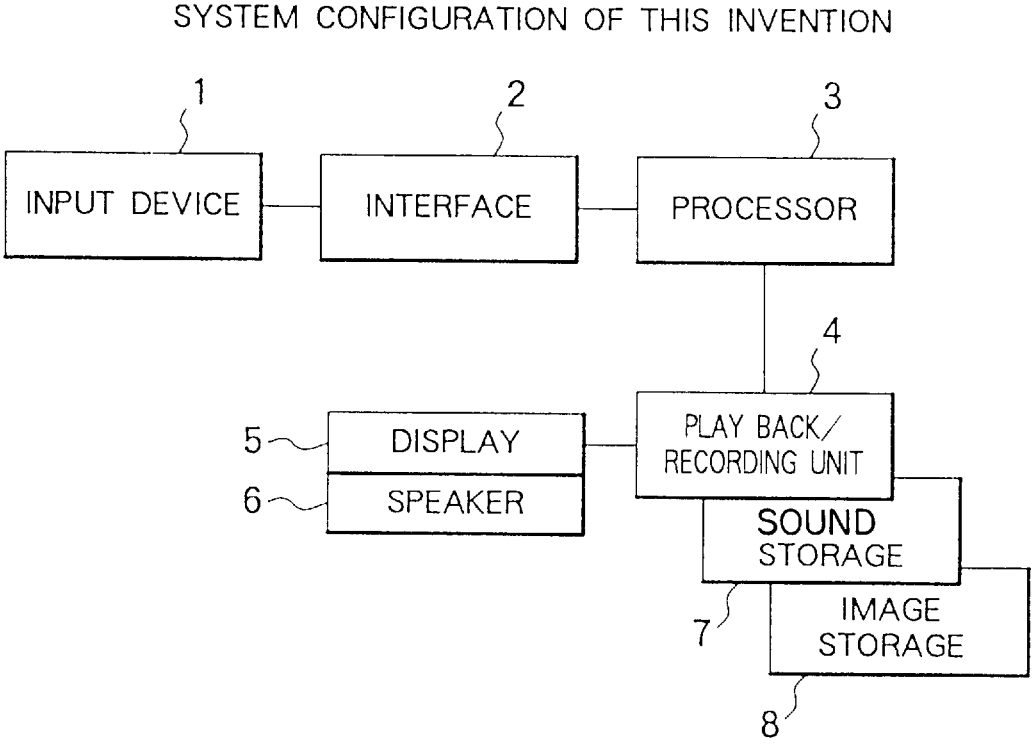
FIG. 1 is a diagram illustrating the system configuration of this invention.

To begin with, means for solving the problems will be outlined, referring to FIG. 1.

In FIG. 1, an input device 1 is used for entering movements, such as the trajectory and movements of a mouse cursor, for example.

An interface 2 is used for detecting any one or any combination of tempo, intensity, beat timing and accent from the movement of the input device 1.

A processor 3 is used for playing back sounds and/or images following the parameters given by the interface 2.

A playback/recording unit 4 is used for displaying on a display 5, playing back from a speaker 6, or recording sounds and/or images in accordance with an instruction to play back sounds and/or images given by the processor 3.

A display 5 is used for displaying images.

A speaker 6 is used for playing back sound.

A sound storage 7 stores an existing piece of music, for example, in the MIDI format. An image storage 8 stores images of scenes of orchestra's concert, or an animation, for example.

The interface 2 detects parameters, such as tempo, intensity (of sound), beat timing and accent, from movements of the input device 1; the processor 3 gives sounds and/or images real-time to the playback/recording unit 4 in such a manner as to follow the detected parameters, such as tempo, intensity, beat timing and accent, to display images on the display 5 or play back sounds from the speaker 6.

At this time, notes for sound being played back may be displayed on a staff together with the image being played back and displayed real-time, with a song pointer moving along with the position on the staff of sound being played back.

The interface 2 is adapted to detect tempo from the repetitive frequency of the movements of the input device 1.

Furthermore, the interface 2 is adapted to detect intensity from the maximum amplitude of the movements of the input device 1.

The interface 2 is also adapted to give beat timing by extracting the start point of the movements of the input device 1.

The interface 2 is also adapted to detect accent from the maximum speed and amplitude of the movements of the input device 1. Moreover, playback is resumed by moving the song pointer to the restart position responding to an instruction for breath given by the input device 1.

All this permits expressions to be added by following the playback of sounds and/or images real-time based on the parameters, such as tempo, intensity, beat timing and accent, detected from the movements of the input device 1.

In the following, embodiments of this invention will be described in greater detail.

The conduct-along system of this invention is a tool for performing music by conducting a virtual orchestra with a virtual baton. This invention makes it possible to conduct music in a virtual manner by calculating tempo, sound volume, etc. from the trajectory drawn by a mouse, for example, which is moved to simulate the movement of a baton.

Characteristics of this invention can be summarized as follows.

i) Software for conducting music in a virtual manner by operating an input device such as a mouse.

The most outstanding feature of this invention is that one can express one's own feeling about music directly in the form of conducting music by using an input device, such as a mouse, commonly used with data processing units. The use of commercially available sequencer software of course permits musical elements, such as tempo and sound volume, to be changed. This conventional sequencer method involving the direct input of numerical values, however, totally lacks real-time operability, far from feeling music in the body.

In addition, this invention has a great advantage that cannot be found with conventional DTM software in that no other manipulations than moving a mouse are required to conduct music, and that there is no need for a knowledge of musical instruments or notation.

ii) Adoption of the standard MIDI format for musical data

This invention employs MIDI, the standard format for musical data. MIDI-based music files of any categories, ranging from classical music to heavy-metal rock, can be obtained by gaining access to WWW in the Internet or on-line services. There is therefore no shortage of music sources. Any musical data obtained by conducting a virtual orchestra on the computer can be stored in MIDI files and transmitted to anywhere in the world.

iii) Two conducting modes, for example, can be selected.

In an embodiment of this invention, two screens are available for conducting operations; the Concert and Rehearsal Modes.

Figure 2:
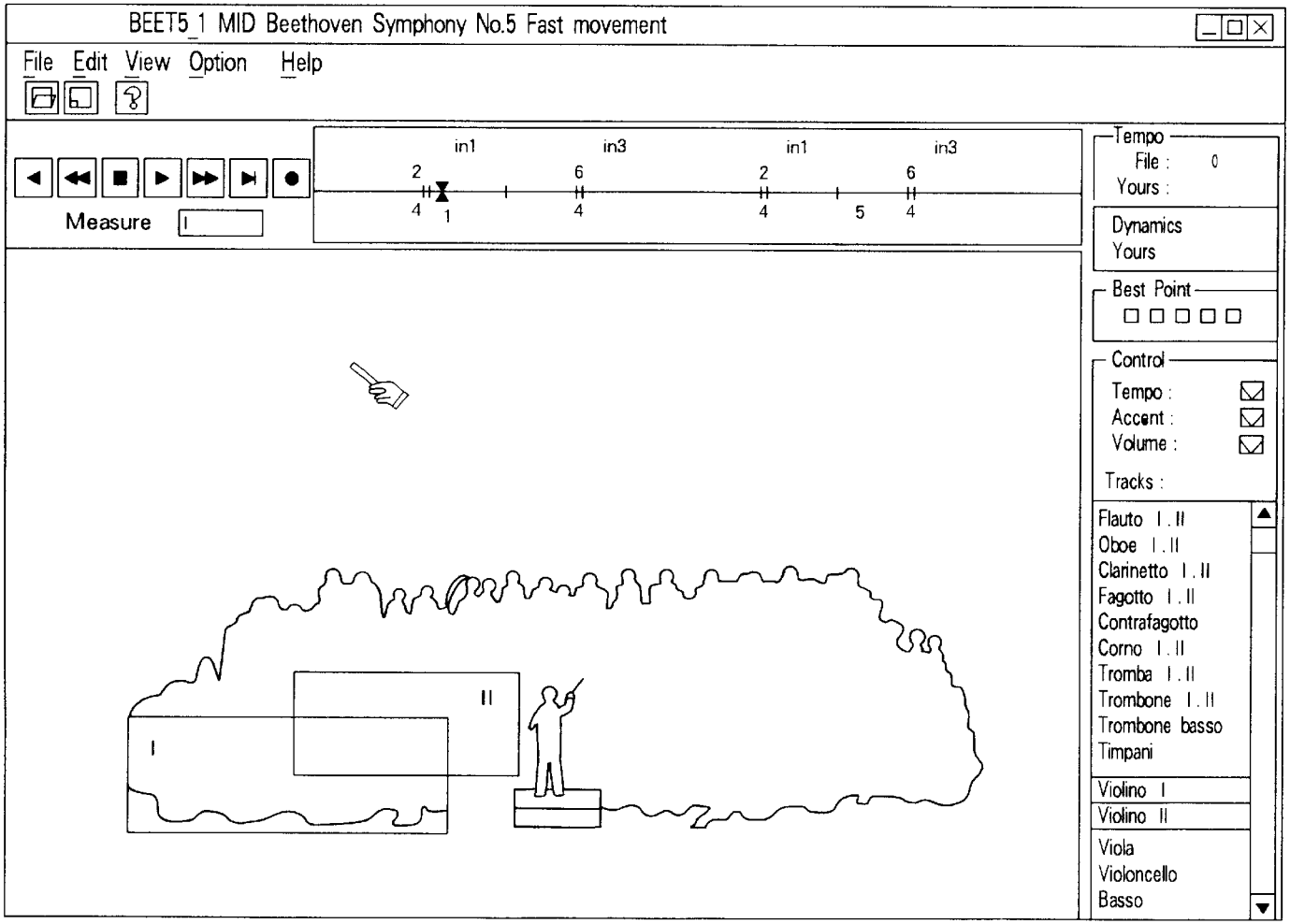
FIG. 2 is a diagram illustrating a typical display in the rehearsal mode.

FIG. 2 shows a typical Rehearsal-Mode screen, in which violin parts I and II are enclosed by frames as necessary so that only those violin parts enclosed by the frames can be selectively conducted to change their tempo and intensity.

Figure 3:
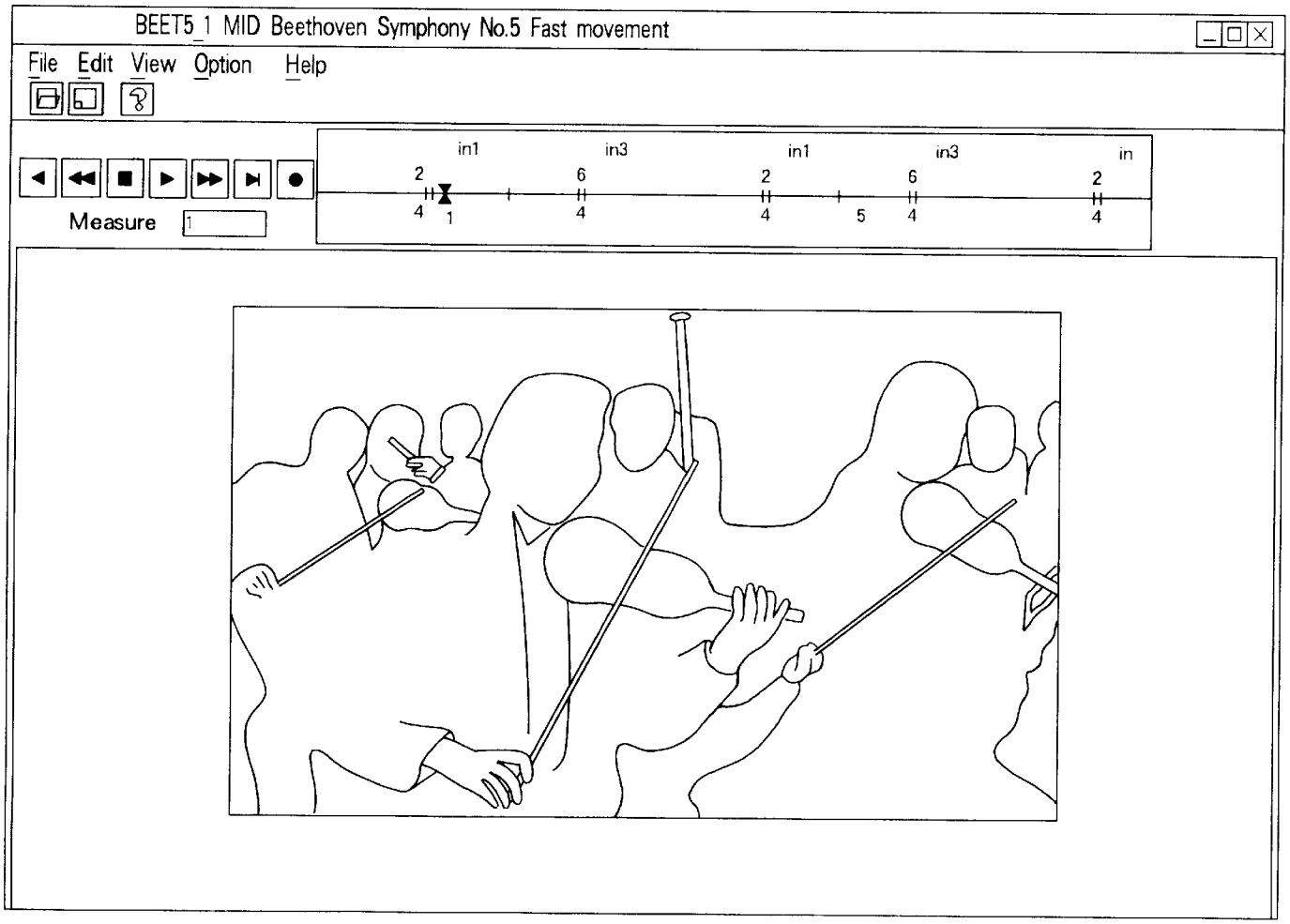
FIG. 3 is a diagram illustrating a typical display in the concert mode.

FIG. 3 shows a typical Concert-Mode screen, representing the scene of a concert so that the entire orchestra can be conducted.

In both screens, conducting operations are almost the same, but conducting can be enjoyed in different ways.

In FIGS. 2 and 3, a pictorial symbol, or icon representing a hand with a baton is displayed on the screen. This icon moves on the screen in much the same way as the operator moves an input device, such as a mouse, giving an impression as if the "hand with a baton" is conducting music.

In the Rehearsal Mode, the training session of an orchestra is simulated and each part is singled out of the orchestra to set in advance intensity and tempo for that part. This mode is characterized by high accuracy in following conducting operations to ensure free musical expressions.

In the Concert Mode, animation or still images (such as a scene of orchestra performance) can be displayed in synchronism with music. In this mode, an entire piece of music is played and conducted, with screens changed over only for a limited duration, 5 minutes, for example, and there is no need of providing animated screens that directly follow conducting operations.

Figure 4:
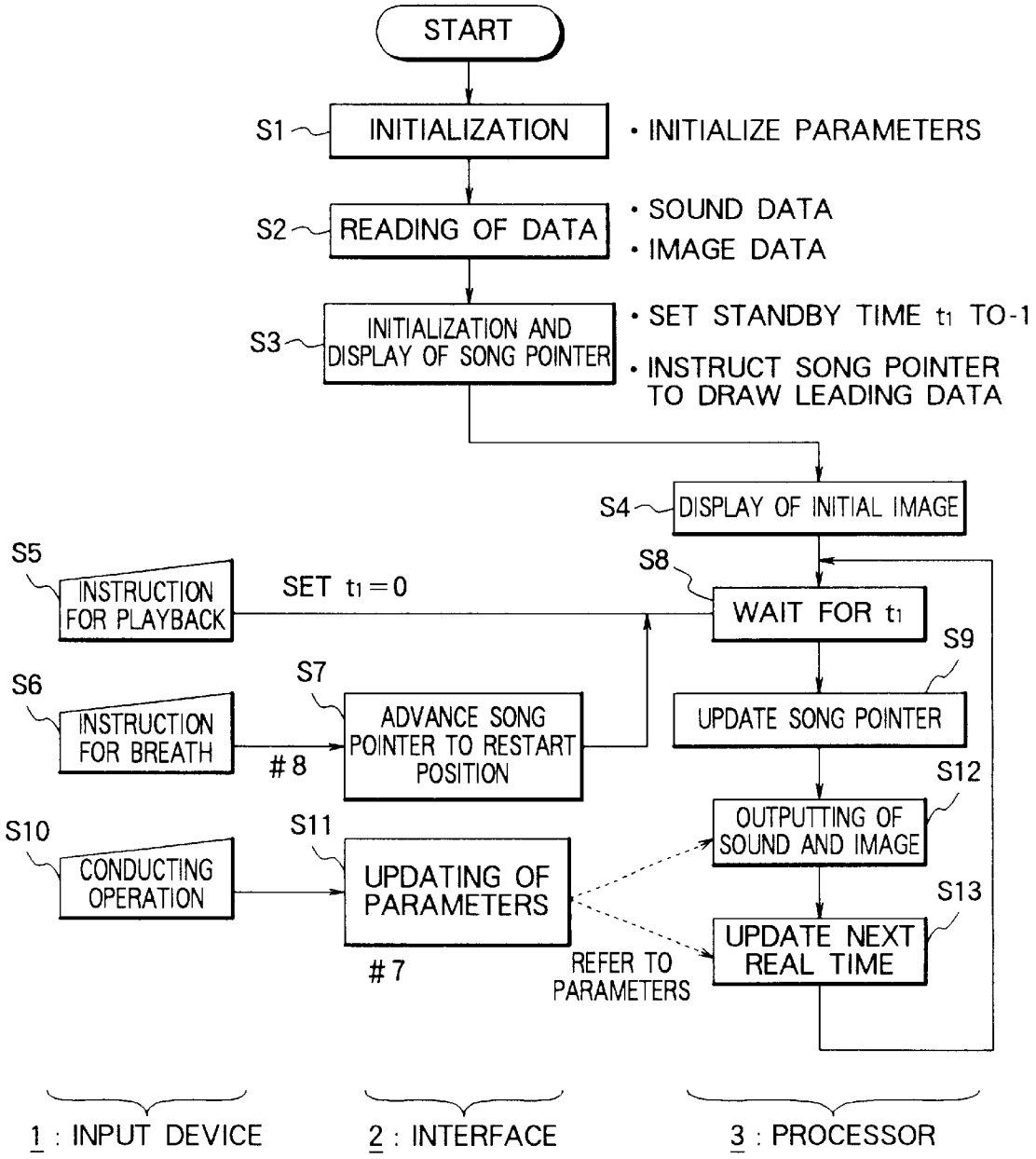
FIG. 4 is a flow chart illustrating the operation of this invention.

FIG. 4 is a flow chart illustrating in detail the operation of the entire configuration of this invention shown in FIG. 1.

In FIG. 4, initialization is carried out in Step S1. That is, parameters (tempo, intensity, beat timing, accent, etc.) are initialized.

In Step S2, sound and image data are read. For example, file data shown in FIG. 10, which will be described later, are read.

In Step S3, the initialization of a song pointer is displayed. That is, a predetermined standby time is given by giving a value of −1 to the standby time (t1), and the song pointer is caused to draw leading data, as shown in the song-pointer display section in the upper part of FIG. 17, which will be described later.

Figure 17:
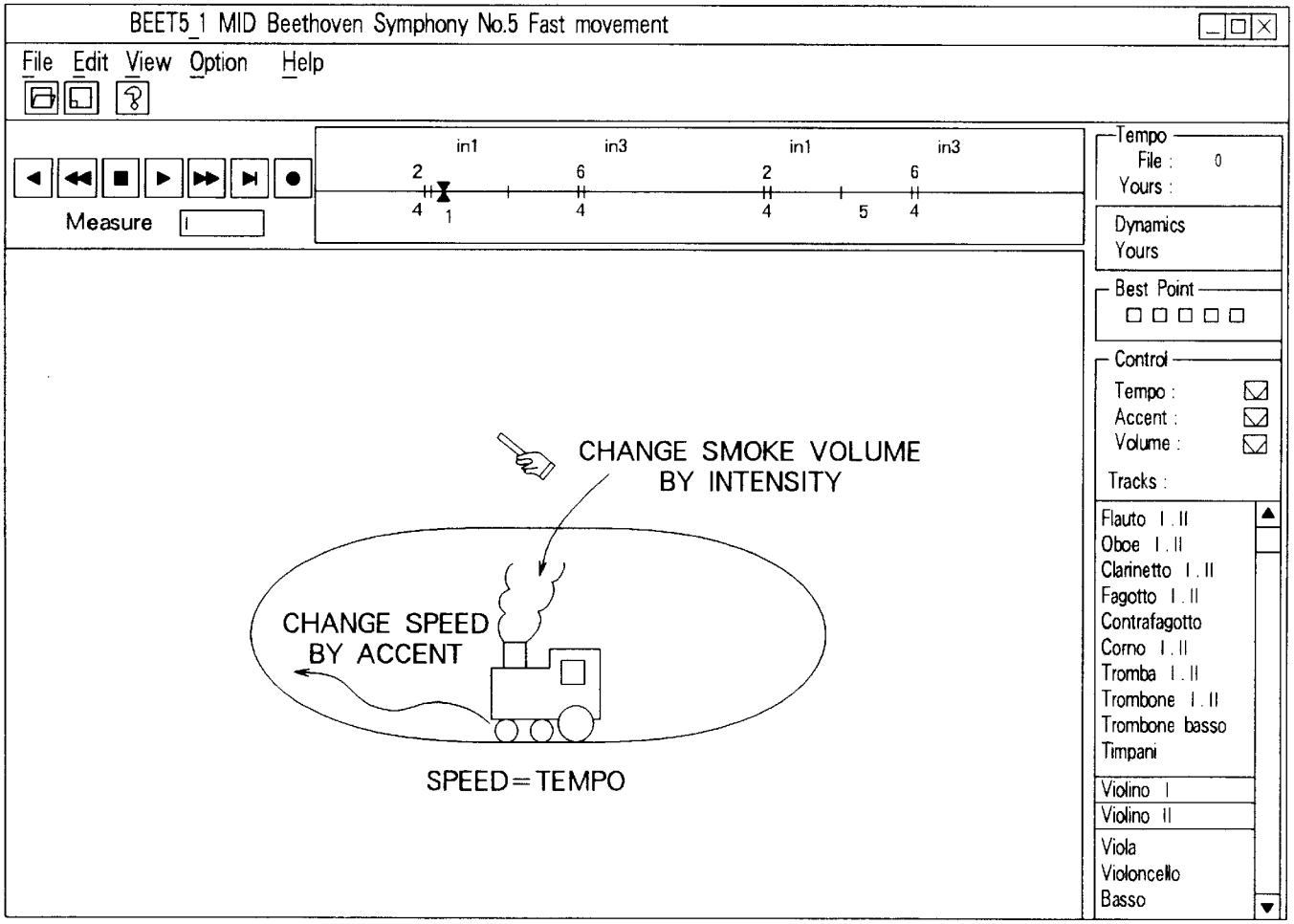
FIG. 17 shows a typical display of animation in this invention.

In Step S4, the processor 3 displays an initial image. In the case of an animation image, for example, an initial image as shown in the middle of FIG. 17, which will be described later, is displayed.

By following Steps S1 through S4, an initial image is displayed on the display 5.

In Step S5, an instruction for playback is given from the input device 1. This turns the standby time (t1=−1) specified in Step S3 into (t1=0) to release the standby state, advancing the processing to Step S8. That is, Step S5 gives the start of music and beat timing.

In Step S6, an instruction for a breath is given by the input device 1 as occasion demands. This causes the interface 2 to advance the song pointer to the restart position in Step S7, advancing the processing to Step S8.

In Step S8, the processor 3 stays on standby for t1. As t1=0, the processor 3 starts.

In Step S9, the song pointer is updated. That is, when an instruction for playback is given, the operation is resumed by positioning the song pointer at the initial, or original position, and positioning the song pointer at the breakpoint when an instruction for a breath is given.

In Step S10, conduct-along operation is carried out using the input device 1.

In Step S11, parameters (tempo, intensity, beat timing and accent) of the movement of the input device 1 are updated as the interface 2 detects these parameters to respond to the conduct-along operation in Step S10.

In Step S12, sound and image outputs are generated. That is, sound is reproduced and/or image is displayed in such a manner as to follow the parameters updated in Step S11.

In Step S13, real time is updated for the next execution, and the operation is returned to Step S8 to repeat Steps S8, S9, S12 and S13.

With the aforementioned operations, sound playback and/or image display are carried out following default parameters (tempo, intensity, beat timing and accent) to respond to an instruction for playback in the state where the initial screen is displayed; and as conduct-along operation is performed, the parameters detected from the movements of the conduct-along operation are updated, and sound playback and image display are changed real-time following the updated parameters. This makes it possible to play back sound and image following the parameters detected from the conduct-along operation real-time so as to add expressions to the reproduced sound and image.

In the following, the conduct-along operation mentioned in Step S10 will be described, referring to FIG. 4.

When conducting a musical piece, a conductor usually gives a wide range of instructions. In addition to the instructions given by the conductor, players carry out performances while seeing how the concert master uses his bow, listening to the sound they themselves and other players produce, feeding back such information to their brains. At this point of time, it is difficult to simulate this complicated system, but the conduct-along system of this invention plays a musical piece by interpreting the conducting graphic forms produced by the operator, that is, the conducting graphic forms drawn by the trajectory of a mouse cursor that simulates a baton.

What a conductor expresses with conducting graphic forms are as follows:

i) Tempo of a musical piece ii) Beat timing iii) Sound volume

In this invention, tempo, beat timing, accent and sound volume that influence expressions of feelings during the playing of a musical piece are controlled real-time by analyzing the conducting graphic form produced by the trajectory of a mouse cursor.

To interpret the conducting graphic form, knowledge of the conducting graphic forms typically used by conductors, and the history and characteristics of conducting graphic forms are essential.

Figure 5:
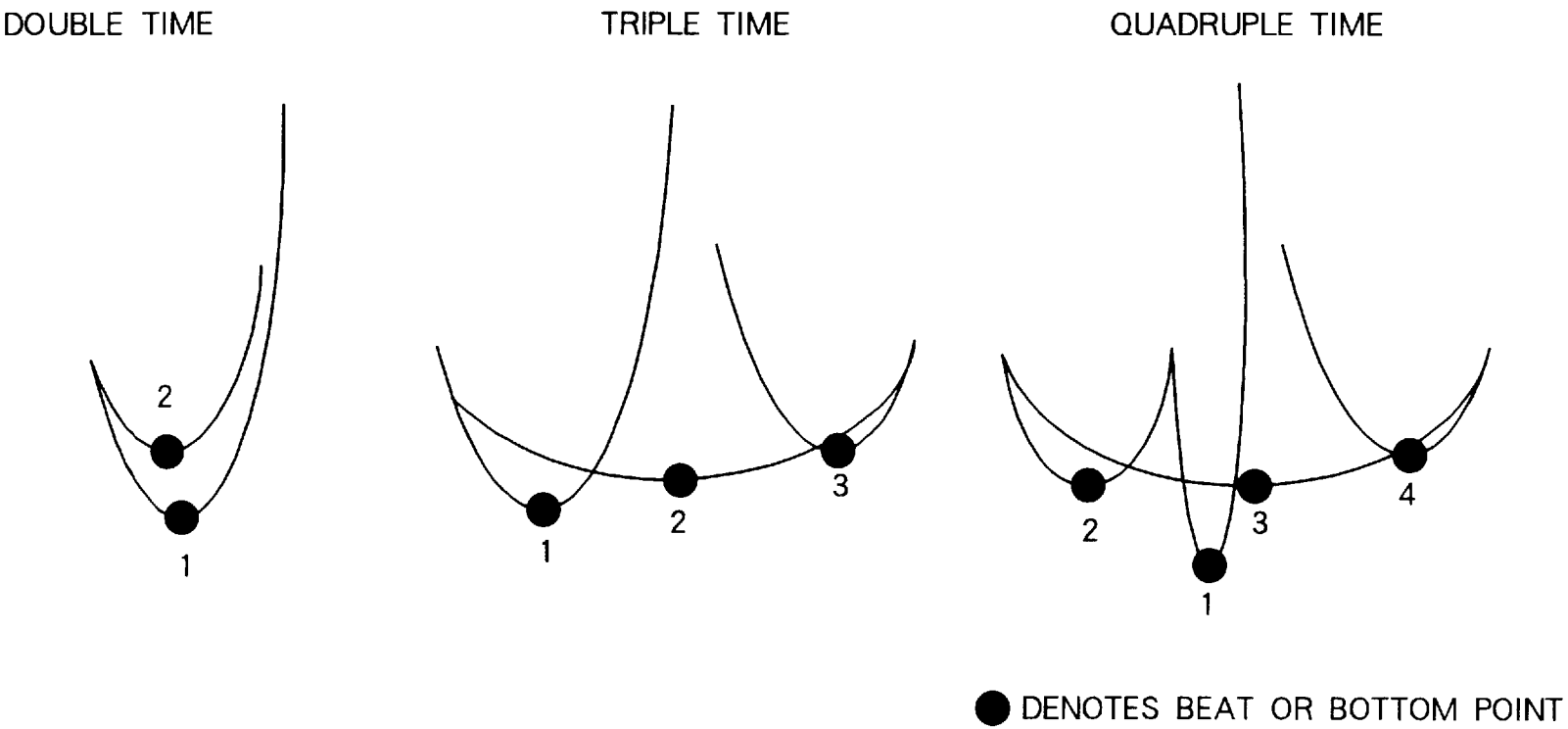
FIG. 5 shows typical music conducting operations.

FIG. 5 shows typical conducting graphic forms for double, triple and quadruple beats. These conducting graphic forms consist of combinations of several conducting operations. This invention analyzes conducting graphic forms by recognizing and extracting common components of conducting operations, rather than separately recognizing individual conducting operations.

In basic conducting operations, a single conducting operation begins half a beat before (up-beat) an intended timing (down beat). After the timing of down beat is given, the conducting operation ends with that down beat. Then, the next conducting operation begins. At the timing of down beat, speed and direction may change rapidly, or speed may gradually reach the maximum. But the lowest position in a graphic form is regarded as the timing of instruction. For the start and end positions, the highest positions in the vicinity of them are assigned.

The point indicating the down beat is often referred to as a bottom point in terms of the method of conducting music. A conductor designates the timing of playing music with one of a beat and a bottom point, and the tempo of music with one of an interval between the beat points and an interval between the bottom points. In this invention, the start or end point (representing connecting point of two conducting operations, or the up beat) of conducting operations is called the beat point, and the lowest point representing the down beat is called the bottom point; and timing and tempo are controlled by detecting or predicting these timings.

The conductor designates sound volume by the size of a graphic form drawn by a baton. In this invention aimed at achieving control with response time of less than one beat, sound volume is controlled by the size of individual conducting operations. A problem here is that the shape and size of conducting operations in a conducting graphic form differ with the number of beats. Controlling sound volume without taking these factors into consideration could cause unnatural periodical changes in sound volume with each measure.

In the following, the method for analyzing changes with time in the coordinates of a mouse and extracting beat and bottom points, tempo and sound-volume elements will be described.

A. Determination of the relationship between conducting operation and hit points The first step for analyzing a conducting operation instructed by a mouse is to predict a beat or bottom point from a conducting graphic form drawn by a mouse. In embodiments of this invention, only the vertical movement on the computer screen of a mouse cursor is considered in determining beat and bottom points, and the horizontal movement of a mouse cursor is not considered in recognizing beat and bottom points. That is, since beat timing is represented by the lowest point of a baton, and up beat that is a timing obtained by halving an interval between beats is represented by the highest point of the baton in the standard pattern of conducting operations, beat and bottom points are recognized by analyzing the vertical movement on the screen of the mouse cursor.

Figure 6:
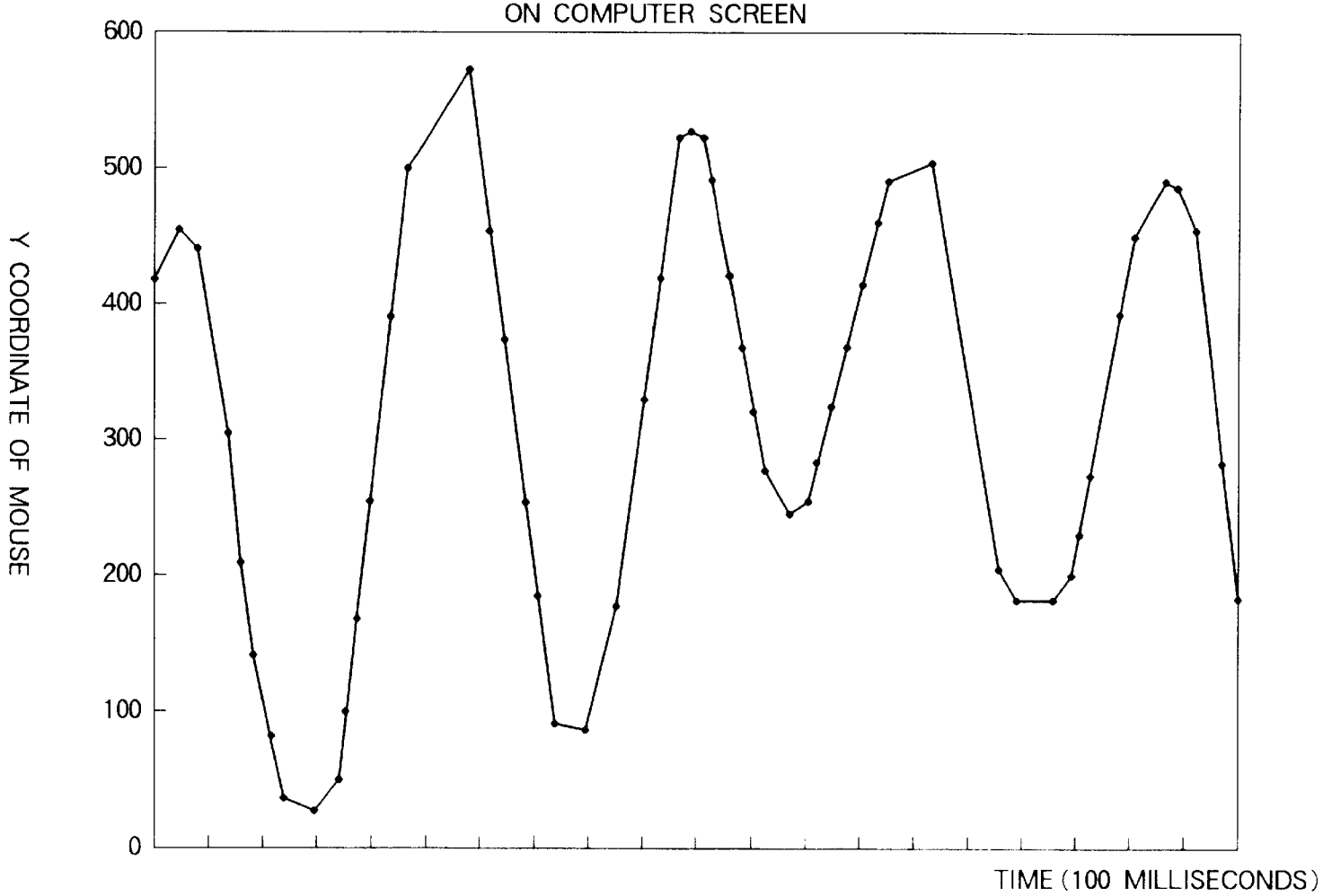
FIG. 6 shows the vertical movement of a mouse cursor.

FIG. 6 is a graph in which the vertical movement of a mouse cursor is plotted with time when an operator, while listening to a musical piece, regularly moves a mouse to the beat of the music.

The figure reveals the following facts.

1) On the Windows operating system, the operation of detecting the movement of the cursor occurs in increments of about 20 to 30 milliseconds. Although this naturally varies, depending on system configuration and the condition of a job, the time interval roughly falls within this range.

2) Since the travel speed of the mouse reaches its minimum in the highest and lowest values in the vertical direction on the screen, the detected operation points become dense. In addition, since the inclination of the curve becomes very gentle in the vicinity of these values, a plurality of the detected operation points may form horizontal lines over time spans of about 50 milliseconds, as shown in FIG. 6.

It follows from this that setting beat and bottom points from the timing at which the vertical cursor movement reaches the minimum or maximum value could cause the following inconveniences:

1) Although an accuracy of a group of twelve (12) notes is required to discriminate a triplet from a 16th note, the accuracy of a 120-beat/min tempo (almost the same tempo as a march) is 40 milliseconds. The use of sampling time, at which the vertical cursor movement reaches the minimum or maximum, with an accuracy of 20 milliseconds would cause problems in playing back music.

2) As there are several points having similar vertical coordinate values in the vicinity of the maximum and minimum cursor movement values, it is difficult to estimate the exact time at which the vertical cursor movement reaches the maximum or minimum value even if the neighboring points are taken into account.

For these reasons, it is not adequate to use as beat and bottom points those points at which the vertical cursor movement reaches the maximum or minimum.

Figure 7:
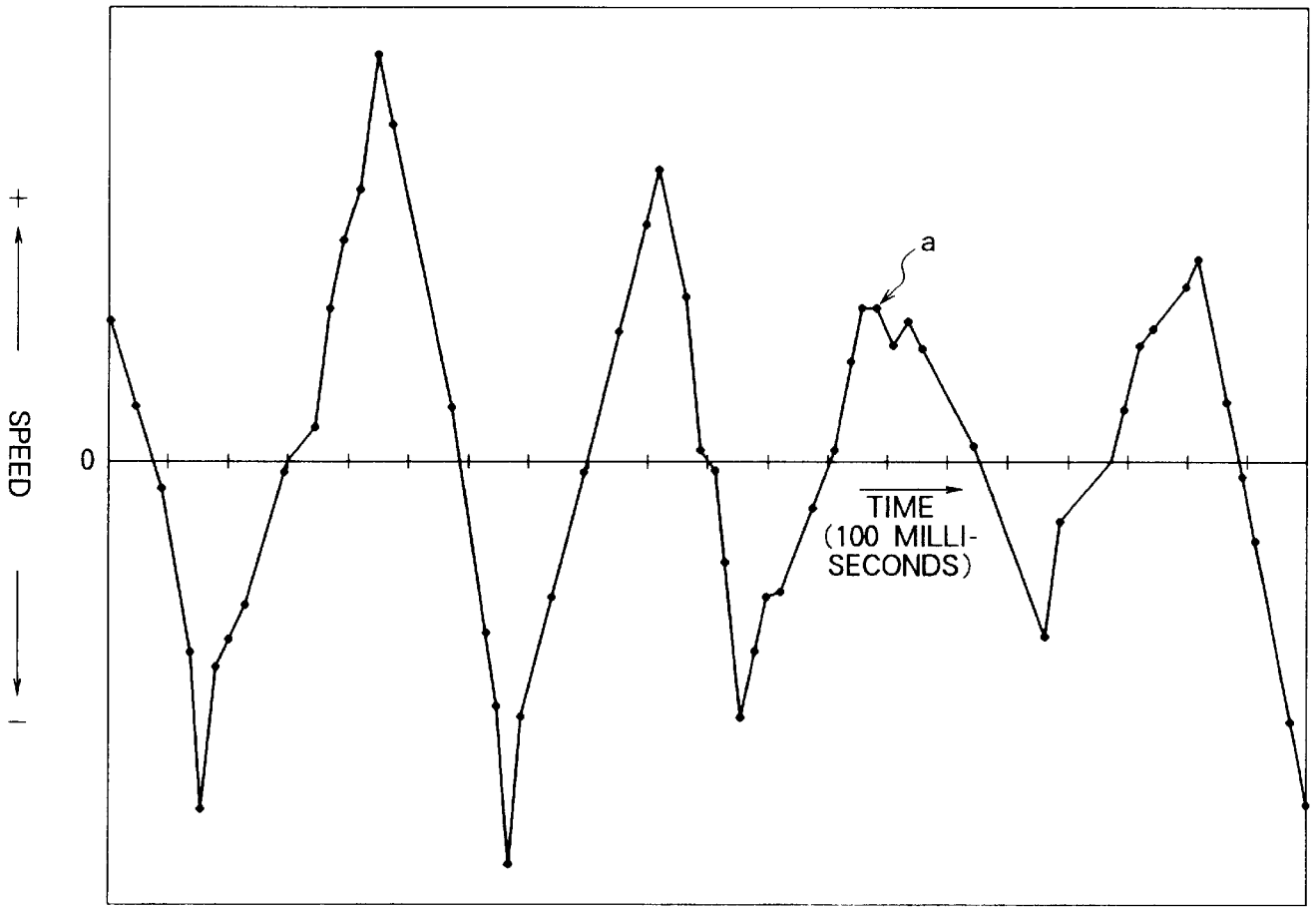
FIG. 7 shows a speed graph of a mouse cursor.

FIG. 7 is a graph on which the speed of a cursor in the vertical direction of the computer screen is plotted based on the data shown in FIG. 6.

The figure reveals the following facts.

1) In the neighborhood of the maximum or minimum speed of the vertical cursor movement, three sampling points, including the preceding and succeeding points, form a shape close to an isosceles triangle, with a sharp peak at the central point.

2) As shown by a in the figure, however, there may contain several points that never form a triangle. Moreover, these points are often found in the neighborhood of the peak.

In view of the fact that the graph shown in FIG. 7 has generally sharp points, it is obviously more advantageous to estimate beat and bottom points from the peaks in the graph of FIG. 7 than predicting beat and bottom points from the peaks in the graph of FIG. 6. It is not necessarily sufficient to estimate beat and bottom points from the points at which the vertical cursor speed reaches the maximum or minimum value because the curve is often distorted in the vicinity of the peaks.

Consequently, this invention employs a method of estimating beat and bottom points from the average value of speed, ranging from the point at which the speed is zero to the point at which the speed becomes zero again, including the points at which the speed reaches the maximum and minimum values. That is, beat and bottom points are estimated in this invention, based on the time at which the speed of the cursor movement reaches the maximum or minimum value.

B. Calculation of tempo

Music playback or animation images are updated in synchronism with the beat and bottom points designated by the conductor. For this reason, tempo is calculated real-time in this invention, based on the time interval between beat and bottom points.

To begin with, what will happen when tempo is calculated with the simplest method of calculating tempo from the most recently detected beat and bottom points will be described.

Figure 8:
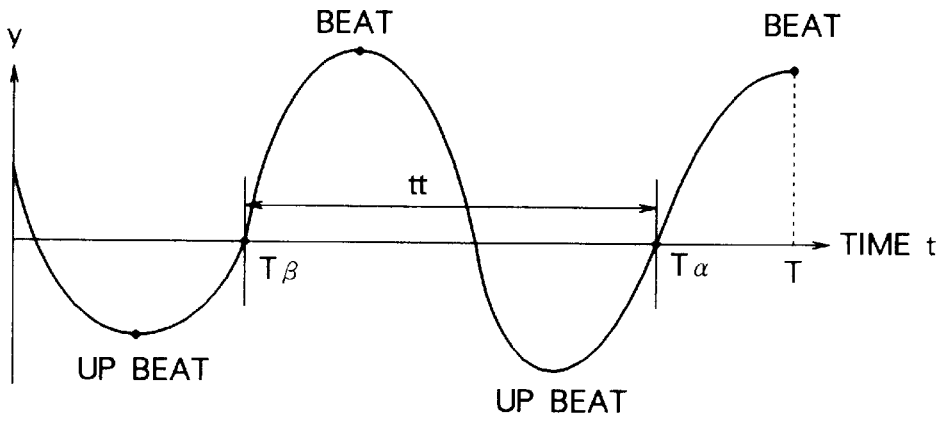
FIG. 8 is a diagram of assistance in explaining the calculation of tempo in the prior art.

FIG. 8 is a diagram of assistance in explaining tempo calculation. In FIG. 8, the most recently detected two beat or bottom points $\alpha$ and $\beta$ with respect to time T are used. Since tempo means the time required for a beat, the tempo at time T becomes tt.

Incorporating the tempo calculated with this method in music playback real-time indicated that the tempo of music responds to the conducting operation caused by the mouse movement too quickly to sustain the conducting operation. This means that a conduct-along system must respond to human conducting operations rather sluggishly. More specifically, a conduct-along system must have the following requirements.

1) Even when there are some fluctuations in tempo, the system should be able to play music smoothly, ignoring such fluctuations.

2) If an abrupt change occurs in tempo, the conduct-along system should respond to the change rather slowly.

The requirement 1) can be met by calculating a tempo not only from the immediately preceding beat or bottom point but also based on the time from the beat or bottom point considerably before the present beat or bottom point to the present one, and taking it into consideration. This helps stabilize the tempo.

The requirement 2) can be met by taking into account the previous tempo. By doing this, the conduct-along system can respond to abrupt changes more slowly.

Figure 9:
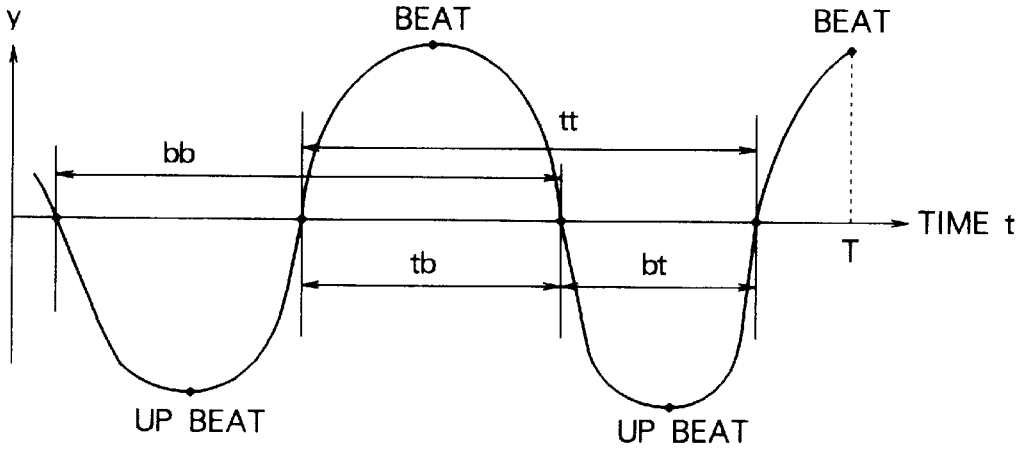
FIG. 9 is a diagram of assistance in explaining the calculation of tempo in an embodiment of this invention.

FIG. 9 is a diagram of assistance in explaining the calculation of tempo by taking into account the past tempo. The tempo at time T is calculated by obtaining the weighted average of the four types of tempos, such as tt, bt, tb and bb, as shown in FIG. 9 at a ratio given below. With this, a conducting operation closest to human sensitivity can result.

tt:bb:tb:bt=2:1:1:0.5

C. Calculation of sound volume

Just as a conductor waves his baton violently to have his orchestra produce bigger sounds, this invention is designed to produce bigger sounds if the mouse is moved a longer distance.

In MIDI data, up to 127 levels of sound volume from the minimum level of 0 to the maximum level of 127 are designated for each note. By adding an offset value calculated from the travel distance of the mouse, sound volume can be adjusted real-time in this invention. The offset value is given by the following equation.

$$\text{offset} = \frac{\left\{ 128 \times \frac{dx + 2(dy)}{\max X + 2(\max Y)} - 64 \right\} + \text{lastoffset}}{2}$$

where max X and max Y represent sizes of the conducting screen in the X and Y directions, respectively, and dx and dy denote travel distances of the mouse between beat or bottom points. The reason why dy and max Y are doubled in the equation is to adjust for the aspect ratio of 1:2 of the conducting screen.

"lastoffset" is the immediately preceding offset value. Abrupt changes in sound volume can be controlled by calculating the average with the lastoffset.

D. Synchronism control

As noted earlier, tempo is determined for every half beat. If the tempo determined in this way is simply reflected in music playback by every beat or bottom point, both playback and conducting operation become quite unnatural. This is because when a tempo deviates greatly between a beat or bottom point and the next beat or bottom point, the beat or bottom point in a conducting operation may deviate from the part of music playback to which the conducting operation is originally intended to correspond, or a sudden change in tempo may occur at the next beat or bottom point. In such a situation, even if the mouse movement is completely stopped during the conducting operation, the music playback may be continued at the original tempo. This is because even if a change in tempo occurs at every beat or bottom point, no beat or bottom points are detected as long as the mouse remains stationary.

To overcome these shortcomings, the conduct-along system of this invention exerts control while maintaining synchronism between conducting operations and music playback. To this end, the conduct-along system of this invention always monitors how many beats either of the conducting operations or music playback deviates at every half beat of the conducting operation and the music playback. If any deviation is detected, the deviation is corrected quickly by adjusting the speed of music playback real-time. More specifically, a perfect synchronism is maintained between conducting operations and music playback by carrying out the correcting operations shown in Table 1.

As for images being displayed, a series of images are provided as individual units, and the start points of the images forming individual units are controlled to keep synchronism with main timings during the aforementioned music playback. The images are sequentially displayed at a speed corresponding to the tempo of music playback as occasion demands.

TABLE 1

Deviation in conducting operation and corrective measures

| Deviation in conducting operation | Corrective measure |
|---|---|
| When conducting operation advances by more than 1 beat | Double the music playback speed. |
| When conducting operation advances by a half beat | Increase the music playback speed by a factor of 7/6. |
| When conducting operation lags a half beat behind | Reduce the music playback speed by a factor of 3/5. |
| When conducting operation lags more than 1 beat behind | In the concert mode, reduce the music playback speed by a factor of ½. In the rehearsal mode, music playback is withheld until the next best or bottom point is detected. |

FIG. 10 is a diagram illustrating how file data correspond with a notation.

The notation shown in the upper part of FIG. 10 is expressed by file data shown in the lower part of the figure. That is, the 4/4 time is first instructed, and then the C major, a tempo and a change in intensity are instructed. After that, NOTEON (for the tone mi) and NOTEON (for the tone sol) messages are described with the difference time (tick) set at the same value so as to instruct to turn on both the tones mi and sol together. A change in intensity is then instructed. After the lapse of a predetermined time, NOTEOFF (for the tone mi) and NOTEOFF (for the tone sol) messages are described to instruct to turn off both the tones mi and sol together, and a NOTEON (for the tone do) message is described to instruct to turn on the tone do at the same point of time. If there is no change in intensity, the change in intensity is not described, and an "End" is described after a NOTEOFF (for the tone do) is described to turn off the tone do after the lapse of a predetermined time.

T in the "Type" column in FIG. 10 denotes tempo, M MIDI data, and E the final data, respectively.

FIG. 11 shows internal data used within the system of this invention, indicating the conversion results of the file data described in FIG. 10.

In embodiments of this invention, music is played back based on the internal data shown in FIG. 11 and in accordance with conducting operations corresponding to a graphic form drawn by an input device such as a mouse. In the following, this process will be described.

In FIG. 10, with the difference time being "0," the "4/4 time," "C major," "tempo 120.0, " "change in intensity 127," "NOTEON 88 (velocity)" and "NOTEON 88 (velocity)" are instructed. After the lapse of 240 ticks, the "change in intensity 63," "NOTEOFF 0 (velocity)," "NOTEOFF 0 (velocity)" and "NOTEON 88 (velocity)" are instructed. Then, after the lapse of 960 ticks from that point of time, "NOTEOFF 0 (velocity)" and "End" are instructed. (Notes) in the right and lower parts of FIG. 10 are given to facilitate the understanding of FIG. 10.

In FIG. 10, elapsed time is indicated by difference time, while in FIG. 11 elapsed time is indicated by the timed elapsed from the time 0 (described as present time).

In FIG. 11, "beat data" are added at the top, and other "beat data" are added at the important parts of the file, whereas the difference time shown in FIG. 10 is copied from FIG. 10 while converted into present time.

That is, after "beat data" are added, the "4/4 time," "C major," "tempo 120.0," "change in intensity 127 (max)," "NOTEON 88 (velocity)" and "NOTEON 88 (velocity)" are copied, with the present time of "0." Next, the "present time" is calculated from the difference between the difference time of No. (7) and the difference time in No. (6) in (Notes) in the right of FIG. 10, and then "beat data" are added.

(Notes) in the right of FIG. 11 describe the relationship with those shown in FIG. 10. As can be seen in these (Notes), "NOTEOFF 0 (velocity)," "NOTEOFF 0 (velocity)" and "NOTEON 88(velocity)" can be obtained, with the present time of "480." Then necessary "beat data" are added, and then "NOTEOFF 0 (velocity)" and "End" are obtained with the present time of "1440."

Figure 12:
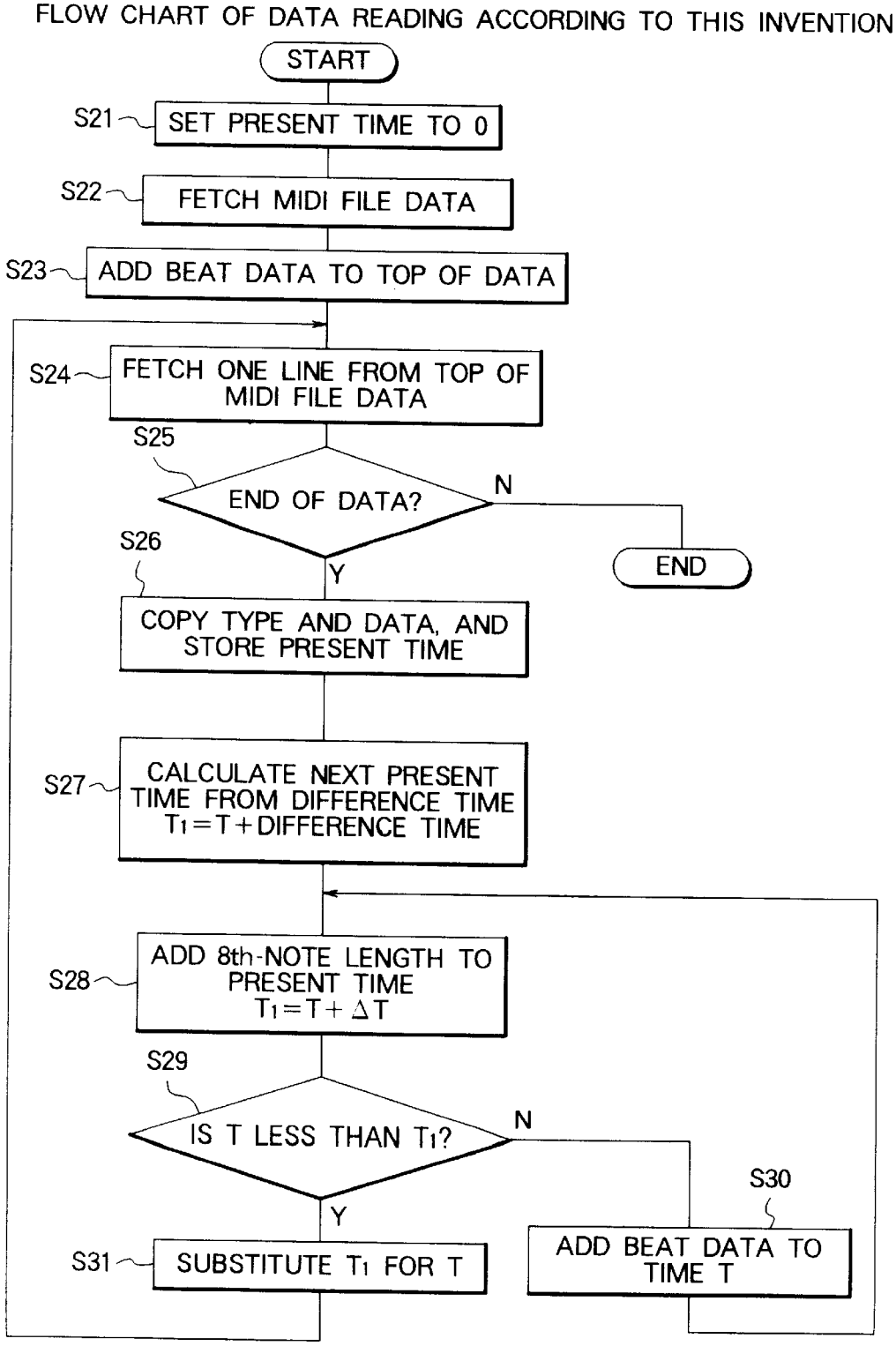
FIG. 12 is a flow chart of reading data according to this invention.

FIG. 12 is a flow chart of reading data in this invention, that is, a flow chart for converting the file data shown in FIG. 10 into the internal data shown in FIG. 11.

In FIG. 12, the present time T is set to 0 in Step S21.

In Step S22, a MIDI data file is read. That is, file data as shown in FIG. 10, for example, are read as MIDI file data.

In Step S23, beat data are added at the top. That is, before the file data of FIG. 10, for example, read in Step S22 are converted into internal data, beat data are added at the top of the converted internal data in FIG. 11.

Figure 13:
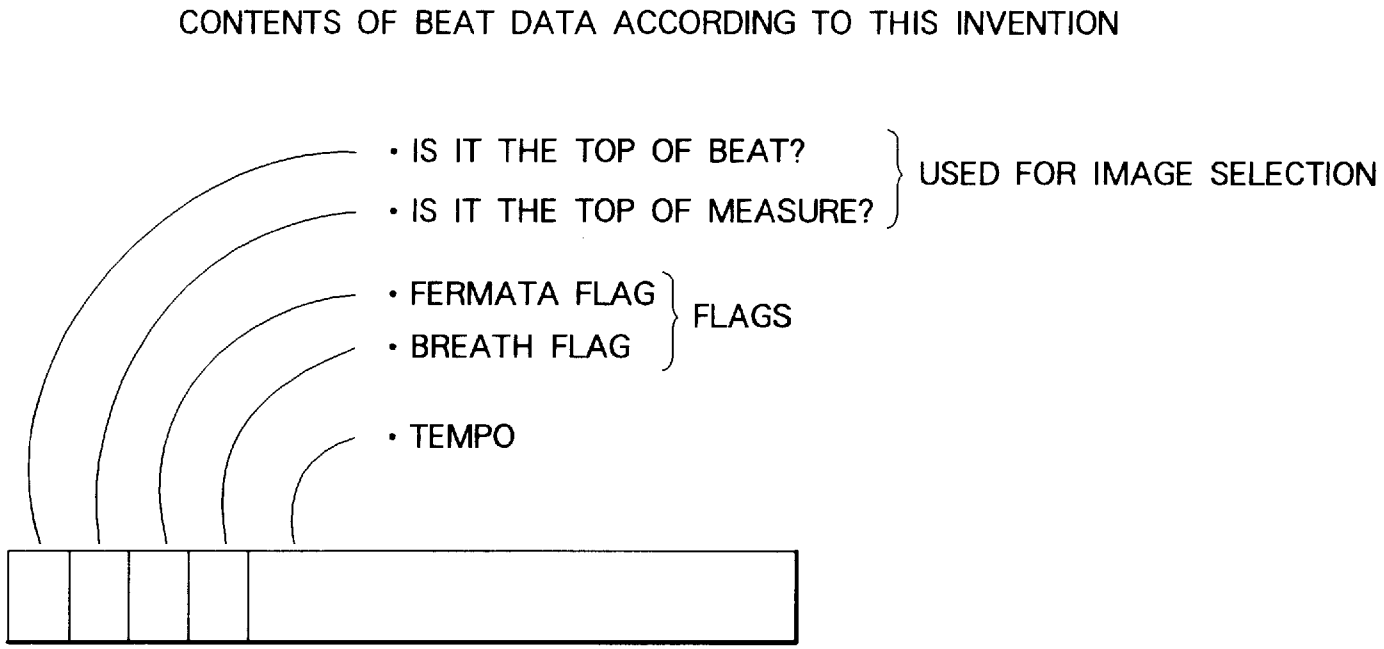
FIG. 13 shows a typical data format of beat data according to this invention.

Beat data have a data format as shown in FIG. 13, which will be described later.

In Step S24, one line is fetched from the top of the MIDI file data, that is, one line is fetched from the top of the original file data fetched in Step S22, or the file data of FIG. 10, for example.

Step S25 judges whether data exist. If YES, the processing proceeds to Step S26. If NO, the processing is terminated as conversion of the MIDI file data fetched in Step S22 into internal data has been completed (End).

In Step S26, type and data are copied, and the present time T is stored. That is, the file data before conversion fetched in Step S24, or the one-line file data at the top of FIG. 10, for example,

| Difference time | Type | Data |
|---|---|---|
| 0 | M | 4/4 time |

are copied on the 2nd line of FIG. 11 after conversion, and the present time T=0 is stored.

In Step S27, the next present time T1 is calculated from difference time by the following equation.

$$T1=T+\text{difference time}.$$

In Step S28, an 8th-note length ΔT is added to the present time as shown in the following equation.

$$T=T+\Delta T.$$

Step S29 judges whether T is less than T1. If NO, T1 is substituted for T in Step S31, and Step S24 and the subsequent operations are repeated. If YES, the time T after the 8th-note length ΔT was added to the present time T has been found to be less than the next present time T1, so that beat data are added to the time T in Step S30.

With the aforementioned processing, up to "4/4 time," "C major," "tempo," "change in tempo," "NOTEON" and "NOTEON" shown in FIG. 10 are copied. Now, assume that the processing for the next "change in intensity 63" reaches Step S26. In this case, the equation $$T1=0+240=240$$

is calculated in Step S27, and $$T=T+\Delta T$$

is obtained in Step S28. Since T≦T1, the processing proceeds to Step S30. That is, beat data are added as shown in FIG. 11.

Then, as beat data are added as shown in FIG. 11, the data shown in FIG. 10 are sequentially copied.

Now, terms used in FIGS. 10 and 11 will be described here.

"Difference time (tick)" is difference time between entries. Types T, M and E are symbols representing types of "tempo," "MIDI data" and "last data," respectively. Data are set as shown in the figure, for example, in accordance with types.

"Tempo" is data representing the tempo for a note (each note on a staff). "Change in intensity 127 (max)" indicates that sound intensity is changed, and that the sound intensity after the change is "127 (maximum)." "NOTEON 88 (velocity)" is data indicating that a sound is generated and its velocity (the intensity of accent) is "88." "NOTEOFF 0 (velocity) is data indicating that sound is stopped and its velocity (the intensity of accent) is 0. "End" represents the last data.

"Present time (tick)" is present time that increases sequentially. (In FIG. 10, "present time" represents difference time between data.) Type B is beat data, or data shown in FIG. 13, which will be described later. Others are those copied from FIG. 10.

In this way, internal data are data in which the present time increases sequentially, as shown in the figure, at a rate of integral multiples of 8th note=240 ticks.

FIG. 13 shows a typical beat data format according to this invention. In the beat data, the following contents are set as shown in the figure.

"Top of beat?"is a flag used for image selection.

"Top of measure" is a flag used for image selection.

"Fermata flag" is a flag to instruct the extension of a sound, when turned on.

"Breath flag" is a flag to instruct the resumption of playback from the interruption of a sound.

"Tempo" is data that describes the tempo of playback of voice or image. The contents of beat data are described in accordance with conducting operations according to this invention by analyzing graphic forms drawn by a mouse, for example.

Figure 14:
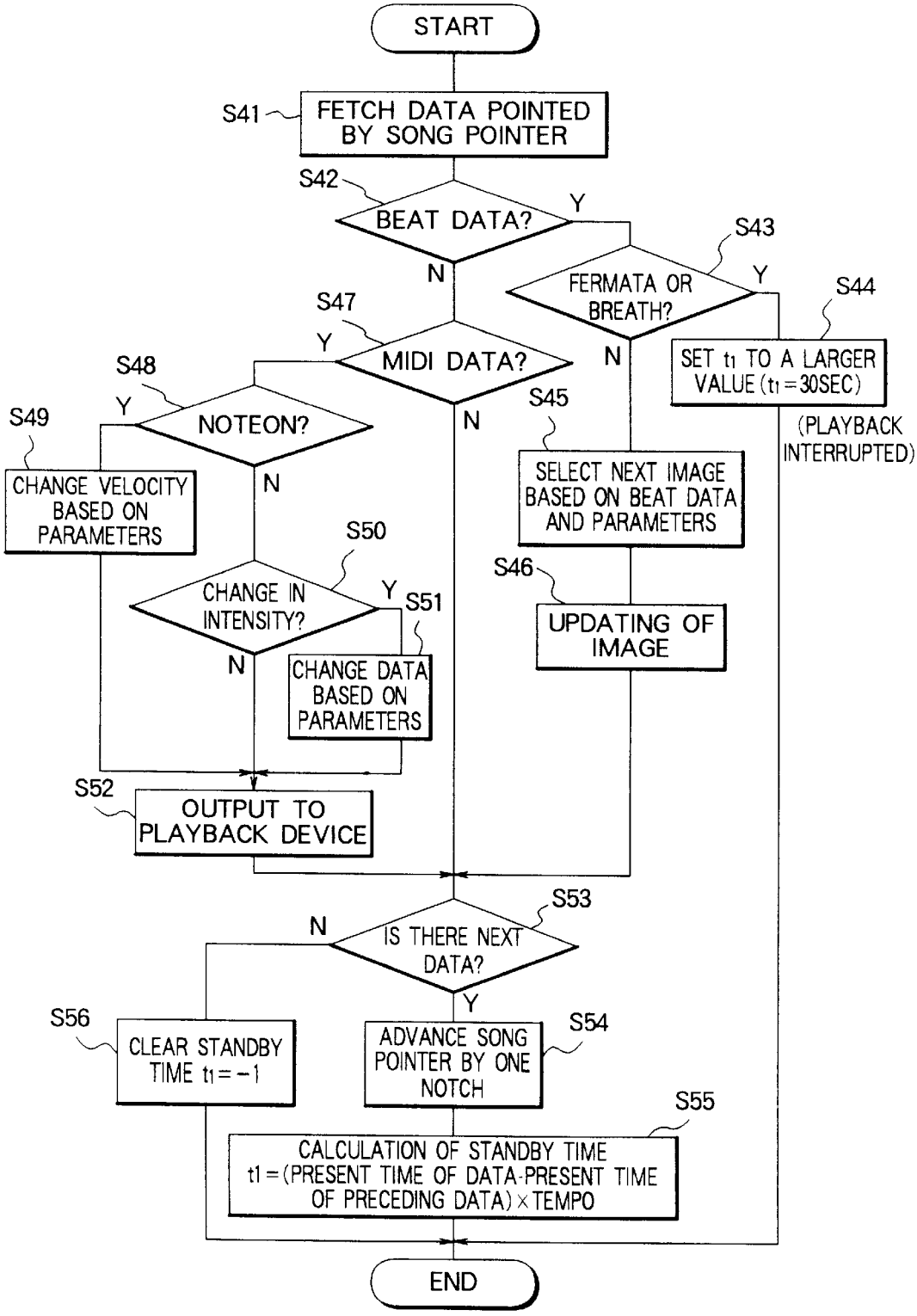
FIG. 14 is a flow chart of playback processing in this invention.

FIG. 14 is a flow chart of playback processing according to this invention. It is a flow chart of detailed playback processing in Steps S9, S12, S13, etc. shown in FIG. 4.

In FIG. 14, Step S41 fetches data indicated by a "song pointer" given in the left of the internal data shown in FIG. 11, for example.

Step S42 judges whether the data fetched in Step S41 is beat data. If YES, the processing proceeds to Step S43. If NO, the processing proceeds to Step S47.

Step S43 further judges whether the data judged as beat data in Step S42 is fermata or breath. If YES, music playback is interrupted by changing the standby time t1 to a larger value (t1=30 sec, for example) in Step S44. If NO, the next image is selected based on beat data and parameters in Step S45, image is updated in Step S46, and then the processing proceeds to Step S53.

Step S47 judges whether data are MIDI data. If YES, the processing proceeds to Step S48. If NO, the processing proceeds to Step S53.

Step S48 further judges whether the data judged as MIDI data in Step S47 are NOTEON (start of sound generation). If YES, that is, it was found that the data are MIDI data, its velocity is changed based on the parameters controlling accent in Step S49, output to a playback device in Step S52, and then the processing proceeds to Step S53. If NO in Step S48, on the other hand, Step S50 judges whether the data are a "change in intensity." If YES, the data are changed based on the parameters in Step S51, output to the playback device in Step S52, and the processing proceeds to Step S53. If NO, on the other hand, the data are output to the playback device in Step S52, and the processing proceeds to Step S53.

Step S53 judges whether there are next data. If YES, the song pointer advances by one notch in Step S54, the standby time t1

$$t1=(\text{present time of current data}-\text{present time of preceding data})\times\text{tempo}$$

is calculated in Step S55, and the processing is completed. If NO in Step S53, on the other hand, the standby time is cleared in Step S56, t1 is set to −1, and the processing is completed.

With the aforementioned operations, the data indicated by the song pointer are fetched from among the internal data of FIG. 11, for example, and then the relevant processing is performed after judging whether the fetched data are beat data, and if they are beat data, whether they are fermata or breath. If the data are not beat data, then judgement is made as to whether they are MIDI data. If they are MIDI data, velocity is changed based on the parameters if it is NOTEON. If it is a change in intensity, rather than NOTEON, then the data are changed and output to the playback device. When there is next data, the song pointer is advanced by one notch and the standby time t1 is calculated and updated. By returning the processing to the original point and repeating it, it is made possible to replay the internal data of FIG. 11 following the parameters (tempo, intensity, beat timing and accent) detected from the movement of the input device, and add expressions to sound and image.

Figure 15:
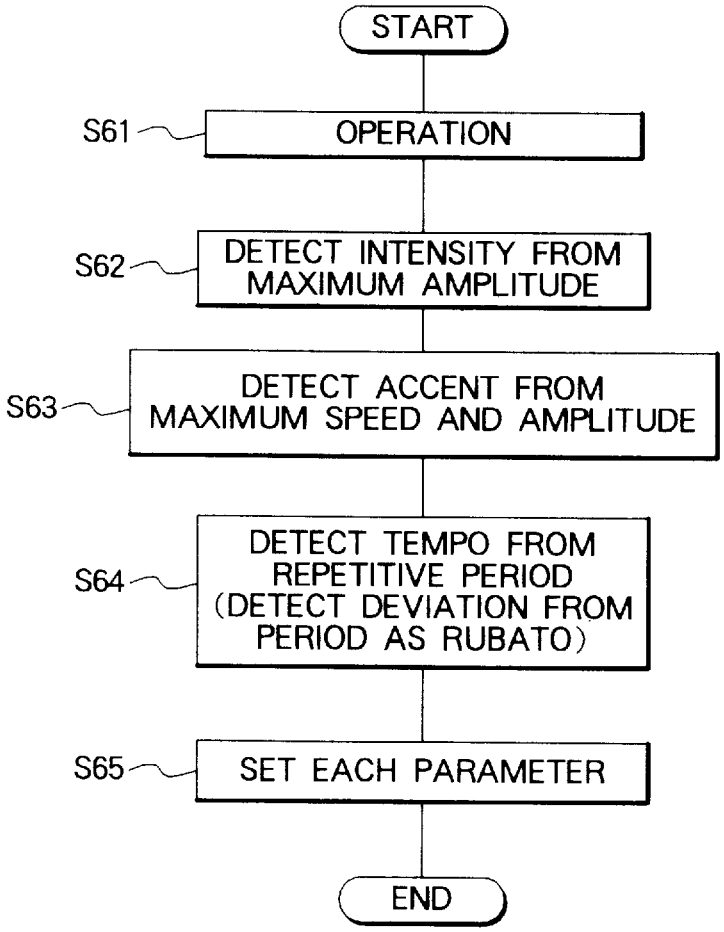
FIG. 15 is a flow chart of updating parameters in conducting operations in this invention.

FIG. 15 is a flow chart of the updating of parameters by the conducting operations of this invention.

In FIG. 15, an input device such as a mouse, is operated in Step S61. That is, the operator plays music by manipulating the input device 1.

In Step S62, the degree of intensity is detected from the maximum amplitude of a graphic form drawn by the input device 1. In other words, intensity is detected from the maximum amplitude of the movement of the input device 1 as the operator plays music by manipulating the input device 1 in Step S61.

In Step S63, accent is detected from the maximum speed and amplitude. That is, accent is detected from the maximum speed and amplitude of the movement of the input device 1 as the operator plays music by manipulating the input device 1 in Step S61.

In Step S64, tempo is detected from repetitive period and deviation from the period is detected as rubato. That is, tempo is detected from the repetitive period of the movement of the input device 1, and deviation from the period is detected as a rubato.

In Step S65, parameters are set. That is, the intensity, accent, and tempo (rubato) detected in Steps S62 to S64 are set as the contents of the beat data shown in FIG. 13. This makes it possible to add expressions to sound and image by reproducing the aforementioned internal data of FIG. 11 in accordance with the parameters.

Figure 16:
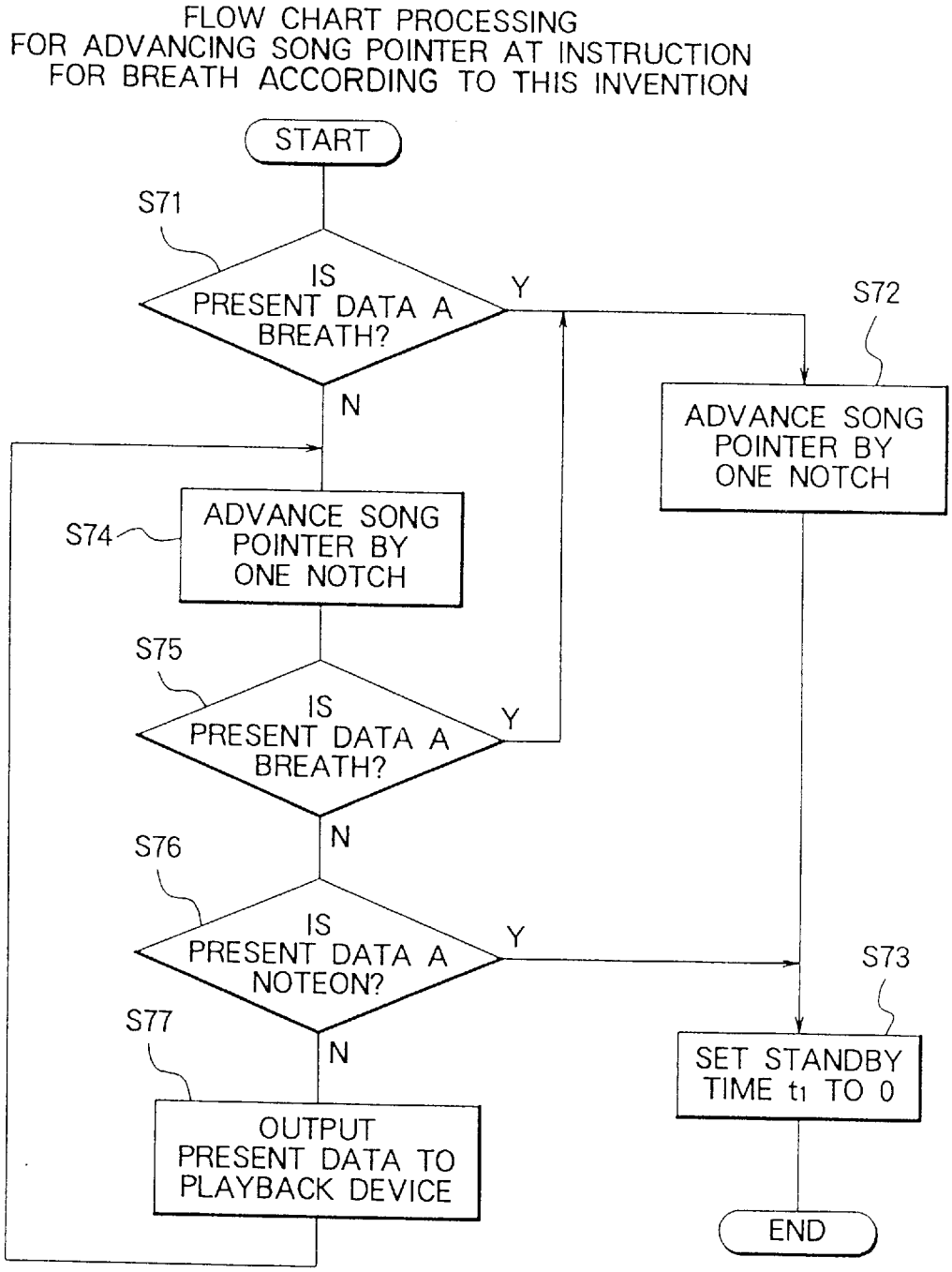
FIG. 16 is a flow chart of processing for advancing a song pointer when breath is designated.

FIG. 16 is a flow chart of the processing of advancing the song pointer when instructing the aforementioned breath in this invention.

In FIG. 16, Step S71 judges whether the current data are a breath. That is, Step S71 judges whether a breath flag is turned to the ON state in the beat data fetched from the aforementioned internal data of FIG. 11, for example. If YES, the song pointer is advanced by one notch in Step S72, and the standby time t1 is set to 0 in Step S73, that is, playback is resumed. If NO, the processing proceeds to Step S74.

In Step S74, the song pointer is advanced by one notch as it was found in Step S71 that the data are not a breath, and the processing proceeds to Step S75.

In Step S75, whether the current data are a breath is judged. If YES, the processing proceeds to Step S72, and the standby time t1 is set to 0 in Step S73, as noted earlier. If NO, on the other hand, the processing proceeds to Step S76.

Step S76 judges whether the current data are NOTEON (increase the accent) since it was found in Step S75 that the data are not a breath. If YES, music playback is resumed by setting the standby time t1 to 0 in Step S73. If NO, on the other hand, the current data is output to the playback device.

FIG. 17 shows an example of an animation display according to this invention. In the figure, a song pointer display portion on the upper part of the screen is a region for displaying a song pointer for pointing to the notation now being played back, and various symbols (such as fermata, breath and measure symbols). In the middle of the screen, there is an area for displaying an image of a locomotive, for example, where the speed of the locomotive is caused to follow the tempo, changes in speed to follow the accent, and the smoke of the locomotive to follow the intensity.

Figure 18:
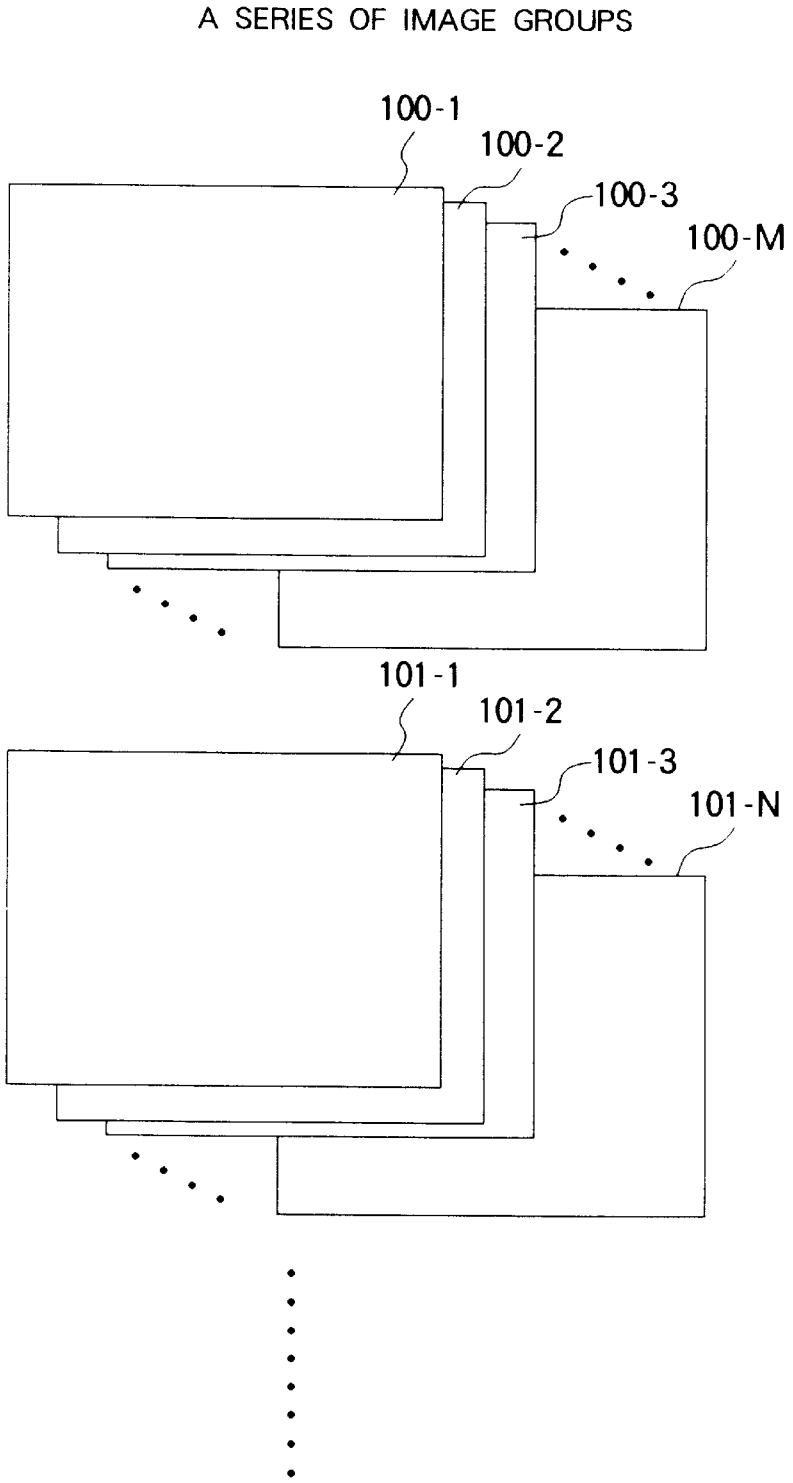
FIG. 18 shows a series of image groups.

FIG. 18 shows a series of images to be stored in an image storage. A series of image groups 100, 101, - - - are stored in the image storage. As an address in which a leading image 100-1 of the image group 100, is stored, and an address in which a leading image 101-1 of the image group 101 is stored are accessed in accordance with an instruction to display the initial image and the song pointer, the image groups are sequentially displayed from the addresses in synchronism with the tempo and in accordance with the playback of images.

Although FIG. 18 shows individual images such as images 100-1, 100-2, - - - 100-M, images according to this invention are not limited to these, but may be video signals as used for television signals.

As described above, this invention has such a construction that expressions can be added to voices and/or images being played back by following the playback real-time based on the parameters, such as tempo, intensity and beat timing, detected from the movement of an input device, such as a mouse, thereby making it possible to add expressions to voice and image being played back by detecting parameters (tempo, intensity, beat timing, accent, etc.) from the movement of an input device 1 (a mouse, and 3-dimensional mouse, for example) which is manipulated by the operator.

What is claimed is:

1. A conduct-along system for adding expressions to sounds and/or images output by a data processing system, said conduct-along system comprising:

an input device including a mouse;

means for detecting parameters comprising any one or any combinations of tempo, intensity and beat timing from the movement of a graphic form directly drawn by said mouse; and playback means for playing back sound and/or image in such a manner as to follow any one or any combinations of said detected parameters tempo, intensity and beat timing.

2. A conduct-along system as set forth in claim 1, wherein said sound being played back is stored together with a series of digital information having at least information indicating a time to start sound generation for a sound being generated, information on the intensity of said sound being generated, and information indicating a time to stop sound generation for said sound being generated.

3. A conduct-along system as set forth in claim 1, wherein said image being played back is stored in the form of a series of image groups comprising a plurality of images as a unit, and played back as the start point of said image group forming a unit is synchronized with the timing of generating major sound in the flow of said sound being played back.

4. A conduct-along system as set forth in claim 1, wherein notation of said sound being played back is displayed, together with said image being played back and displayed in real-time, and a song pointer advancing with the progress of music to point out a note representing a sound now being played back.

5. A conduct-along system as set forth in claim 4, wherein said playback means for playing back said sounds and/or images in real-time displays in advance an initial image by initializing the standby time to a predetermined value, cancels the standby time at the start point of the movement of a graphic form drawn by said mouse and starts the playback of sound in accordance with said song pointer, while starting the playback of image from said initial image.

6. A conduct-along system as set forth in claim 4, wherein said playback means for playing back said sounds and/or images in real-time advances said song pointer to a predetermined restart position in accordance with said breath flag, and starts the playback of said sounds and/or images as said standby time is canceled.

7. A conduct-along system as set forth in claim 1, wherein said means for detecting said parameters extracts a moving speed of said graphic form drawn by said mouse on a coordinate axis, and judges beat or bottom points given by said mouse using a lowest point and/or a highest point of said moving speed.

8. A conduct-along system as set forth in claim 7, wherein said means for detecting said parameters detects said tempo from a repetitive period of the movement of said graphic form drawn by said mouse.

9. A conduct-along system as set forth in claim 8, wherein said means for detecting said parameters obtains a tempo as detection results of a tempo being detected by using time of said judged beat or bottom points, and calculates a weighted average of time of one period of said tempo being detected and time of one period of a tempo before said tempo being detected.

10. A conduct-along system as set forth in claim 9, wherein said means for detecting said parameters adds time of a preceding half-period of said one period of said tempo being detected and time of a succeeding half-period of said one period to values subjected to said weighted average.

11. A conduct-along system as set forth in claim 7, wherein said means for detecting said parameters detects said intensity from a maximum amplitude of movement on a coordinate axis of a graphic form drawn by said mouse.

12. A conduct-along system as set forth in claim 11, wherein said means for detecting said parameters uses the maximum amplitude of said movement of said mouse at said point of time being detected and the maximum amplitude of said movement of said mouse before said point of time being detected to obtain the maximum amplitude of detection results on said movement of said input device at said point of time being detected.

13. A conduct-along system as set forth in claim 1, wherein said means for detecting said parameters combines data representing the top of beat corresponding to sound, data representing the top of measure, a fermata flag, a breath flag, and data representing tempo as beat data to hand over to said playback means for playing back sounds and/or images in real-time.

14. A conduct-along system as set forth in claim 1, wherein said playback means for playing back said sounds and/or images in real-time produces internal data by reading a series of digital information in which tick time is described, and adds the contents of said beat data in accordance with changes in said tick time.

15. A conduct-along system as set forth in claim 14, wherein said playback means for playing back said sounds and/or images in real-time comprises a speaker for playing back said sound and/or a display for displaying said image, and plays back said sounds and/or images by analyzing said internal data.

16. A conduct-along system as set forth in claim 1, wherein said playback means for playing back said sounds and/or images in real-time can select playback in a rehearsal mode and in a concert mode.

17. A conduct-along system as set forth in claim 1, wherein said playback means for playing back said sounds and/or images in real-time selects part of images displayed in said display, and plays back only sounds produced in accordance with said selected images.

* * * * *

UNITED STATES PATENT AND TRADEMARK OFFICE

CERTIFICATE OF CORRECTION

PATENT NO.: 5,890,116
DATED : March 30, 1999
INVENTOR(S): Yasunari Itoh, et al.

It is certified that error appears in the above-identified patent and that said Letters Patent is hereby corrected as shown below:

Title Page, [56] References Cited, ADD,
--5,166,463 11/1992 Weber 84/600--;
--5,488,196 1/1996 Zimmerman et al. 84/612--;
--5,665,927 9/1997 Taki et al. 84/609--.

Column 13, line 59, change "voices" to --sounds--.

Signed and Sealed this

Eighth Day of February, 2000

*Attest:*

Q. TODD DICKINSON

*Attesting Officer*

*Commissioner of Patents and Trademarks*